US012722073B2

(12) United States Patent
Wen

(10) Patent No.: US 12,722,073 B2
(45) Date of Patent: Sep. 1, 2026

(54) INTERACTIVE GAMING DEVICE

(71) Applicant: Bin Wen, You (CN)

(72) Inventor: Bin Wen, You (CN)

( * ) Notice: Subject to any disclaimer, the term of this patent is extended or adjusted under 35 U.S.C. 154(b) by 507 days.

(21) Appl. No.: 18/358,973

(22) Filed: Jul. 26, 2023

(65) Prior Publication Data

US 2024/0017163 A1 Jan. 18, 2024

(30) Foreign Application Priority Data

May 23, 2023 (CN) ..... 202321265110.1

(51) Int. Cl.
*A63F 9/00* (2006.01)
*A63F 9/24* (2006.01)

(52) U.S. Cl.
CPC ..... *A63F 9/001* (2013.01); *A63F 9/24* (2013.01); *A63F 2009/0033* (2013.01); *A63F 2009/2454* (2013.01)

(58) Field of Classification Search
CPC ..... A63F 9/001; A63H 33/28; A63H 23/00
See application file for complete search history.

(56) References Cited

U.S. PATENT DOCUMENTS

| | | | | |
|---|---|---|---|---|
| 8,313,379 | B2 * | 11/2012 | Ikeda | A63F 13/98 345/158 |
| 2005/0164764 | A1 | 7/2005 | Ghaly | |
| 2011/0034250 | A1 | 2/2011 | Brandt | |
| 2013/0324243 | A1 | 12/2013 | Mikhailov et al. | |
| 2018/0085677 | A1 * | 3/2018 | Atsuzawa | A63H 19/14 |
| 2021/0370164 | A1 * | 12/2021 | Lu | A63F 13/235 |
| 2022/0100280 | A1 * | 3/2022 | Nocon | G06V 40/28 |
| 2023/0135754 | A1 * | 5/2023 | Yang | A63H 33/28 446/15 |

* cited by examiner

*Primary Examiner* — Eugene L Kim
*Assistant Examiner* — Samantha M Berry
(74) *Attorney, Agent, or Firm* — Hemisphere Law, PLLC

(57) ABSTRACT

The present disclosure discloses an interactive gaming device, including a housing assembly, which is a hollow cavity; a circuit board, a battery, a light-emitting diode (LED) assembly, and a horn which are fixedly arranged in the housing assembly respectively, wherein the circuit board is provided with a gyroscope, and detects a movement trajectory of the housing assembly in real time; an infrared assembly and an atomization assembly which are arranged at a front end of the housing assembly, wherein the infrared assembly can emit and receive infrared rays, and water mist produced by the atomization assembly can be sprayed out of the housing assembly; and a button assembly arranged on the circuit board and penetrating through the housing assembly.

15 Claims, 4 Drawing Sheets

INTERACTIVE GAMING DEVICE

TECHNICAL FIELD

The present disclosure relates to the technical field of gaming equipment, and particularly to an interactive gaming device.

BACKGROUND

Children use games, toys, and other similar entertainment equipment to have fun and interact with one another. Commercially available game toys are mainly used to provide valuable learning and entertainment for children, such as role playing, reading, memory stimulation, and contact coordination. However, most of them only provide a superficially charming game experience, with poor interactivity. Especially for the older children, there are very few gaming devices that allow participants to immerse themselves in realistic fantasy experiences such as practice and performance. Therefore, an interactive gaming device is provided to solve the problem of poor interactivity in the gaming devices in the prior art.

SUMMARY

One objective of the present disclosure is to provide an interactive gaming device, so as to solve the problem of poor interactivity of gaming devices in the prior art.

The interactive gaming device of the present disclosure can be achieved by the following technical solutions:

The present disclosure discloses an interactive gaming device, including a housing assembly, which is a hollow cavity; a circuit board, a battery, a light-emitting diode (LED) assembly, and a horn which are fixedly arranged in the housing assembly respectively, wherein the circuit board is provided with a gyroscope, and detects a movement trajectory of the housing assembly in real time; an infrared assembly and an atomization assembly which are arranged at a front end of the housing assembly, wherein the infrared assembly can emit and receive infrared rays, and water mist produced by the atomization assembly can be sprayed out of the housing assembly; and a button assembly arranged on the circuit board and penetrating through the housing assembly.

In one implementation, the housing assembly is in a streamline rod shape, and includes a first housing and a second housing; and the first housing and the second housing are connected through a fastener structure or a screw structure.

In one implementation, the first housing is provided with a through hole and a plurality of horn holes in a penetrating manner; the position of the through hole corresponds to the position of the atomization assembly; the plurality of horn holes are uniformly arranged; and the positions of the horn holes correspond to the position of the horn.

In one implementation, the atomization assembly includes a liquid storage tank and an atomization plate; the liquid storage tank is fixedly arranged in the housing assembly; and the atomization plate is arranged at a bottom of the liquid storage tank and atomizes the liquid flowing out of the bottom of the liquid storage tank.

In one implementation, a liquid injection port is arranged on the liquid storage tank in a penetrating manner; and the position of the liquid injection port corresponds to the position of the through hole.

In one implementation, a blocking cover is arranged at the liquid injection port; and the blocking cover is movably arranged on a side of the through hole.

In one implementation, the circuit board is further provided with a wireless communication module; and the wireless connection module uses one or more of a Bluetooth® wireless communication module, a WI-FI® wireless communication module, a 4G wireless communication module and a 5G wireless communication module.

In one implementation, the battery is a dry battery or a rechargeable battery.

In one implementation, when the battery is the rechargeable battery, the circuit board is further provided with a charging interface; and the charging interface penetrates through the housing assembly, and adopts a Type-C interface, a micro USB interface, or a Lightning® interface.

In one implementation, the housing assembly is detachably connected with a decorating part.

Compared with the prior art, the interactive gaming device of the present disclosure has the beneficial effects below:

The interactive gaming device of the present disclosure monitors the movement trajectory of the device in real time through the gyroscope, and emits and receives the infrared rays to perform the non-contact simulation operation through the infrared assembly, so that the atomization assembly, the LED assembly, and the horn make corresponding responses to different usage scenarios, which greatly improves the interactive function of the device and effectively solves the problem of low interactivity of the gaming device in the prior art. Due to the non-contact simulation operation, the safety of game interaction is improved to a certain extent, and the fun of a game is also increased.

BRIEF DESCRIPTION OF THE DRAWINGS

In order to explain the technical solutions of the embodiments of the present disclosure more clearly, the following will briefly introduce the accompanying drawings used in the embodiments. It should be understood that the drawings in the following description only illustrate some embodiments of the present disclosure and thus shall not be deemed as limiting the scope. Those of ordinary skill in the art can obtain other related drawings based on these drawings without creative work.

Figure 1:
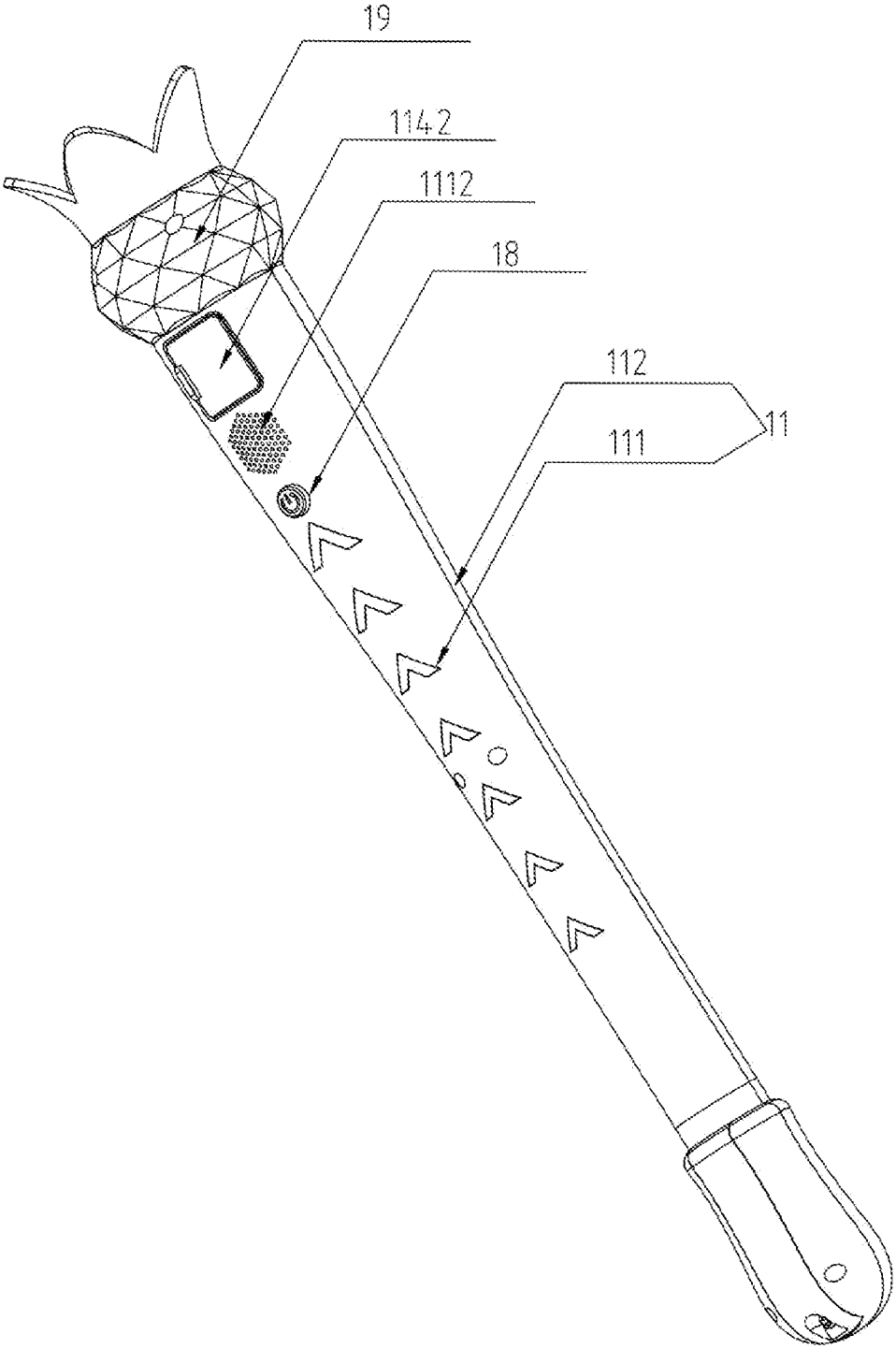
FIG. 1 is a schematic structural diagram of an interactive gaming device according to the present disclosure.
Figure 2:
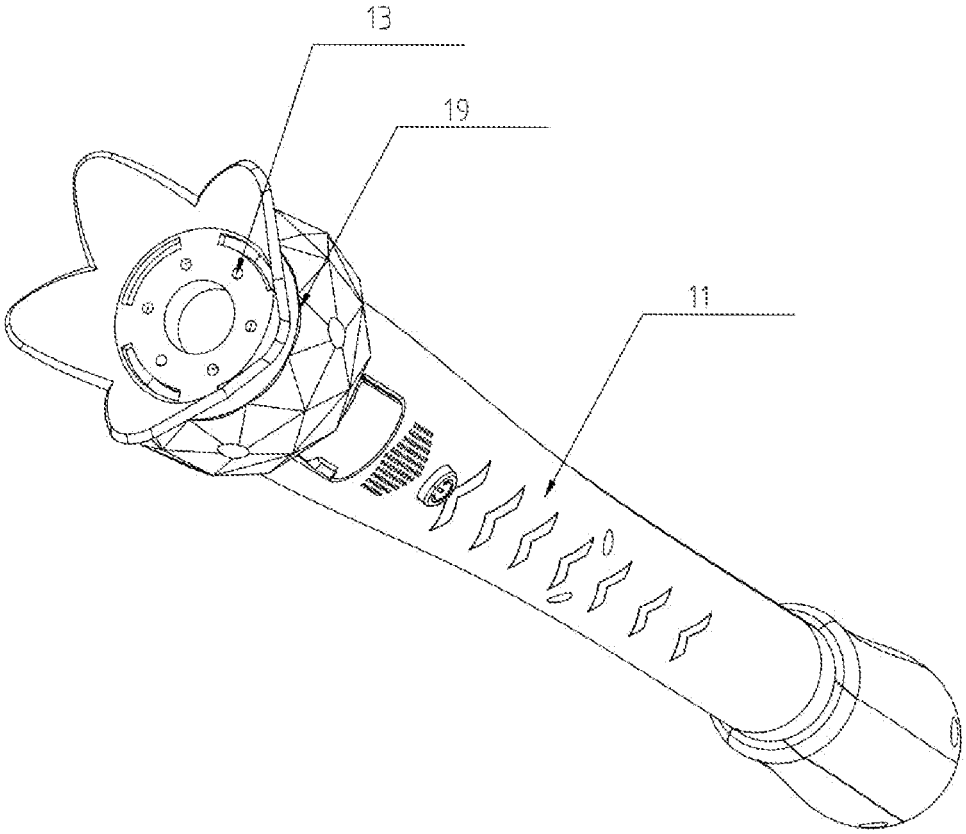
FIG. 2 is a schematic structural diagram of the interactive gaming device shown in FIG. 1 according to the present disclosure in another view.

Reference numerals in the drawings: 11: housing assembly; 111: first housing; 1111: through hole; 1112: horn hole; 112: second housing; 12: circuit board; 121: gyroscope; 13: infrared assembly; 14: atomization assembly; 141: liquid storage tank; 1411: liquid injection port; 1412: blocking cover; 142: atomization plate; 15: battery; 16: LED assembly; 17: horn; 18: button assembly; and 19: decorating part.

DETAILED DESCRIPTION OF THE EMBODIMENTS

In order to make the objectives, technical solutions and advantages of the embodiments of the present disclosure clearer, the technical solutions in the embodiments of the present disclosure will be described clearly and completely below in combination with the drawings in the embodiments of the present disclosure. Obviously, the embodiments described herein are part of the embodiments of the present disclosure, not all the embodiments. The components of the embodiments of the present disclosure generally described and shown in the drawings here can be arranged and designed in a variety of different configurations.

Therefore, the following detailed description for the embodiments of the present disclosure provided in the accompanying drawings is not intended to limit the scope of the claimed present disclosure, but merely represents selected embodiments of the present disclosure. All other embodiments obtained by those of ordinary skill in the art based on the embodiments in the present disclosure without creative work shall fall within the protection scope of the present disclosure.

Referring to FIG. 1 to FIG. 4, the present disclosure provides an interactive gaming device, which can include a housing assembly 11, a circuit board 12, an infrared assembly 13, an atomization assembly 14, a battery 15, an LED assembly 16, a horn 17, and a button assembly 18. The housing assembly 11 is a hollow cavity. The circuit board 12, the battery 15, the LED assembly 16, and the horn 17 are fixedly arranged in the housing assembly 11 respectively. The circuit board 12 is electrically connected to the infrared assembly 13, the atomization assembly 14, the battery 15, the LED assembly 16, and the horn 17 respectively. The battery 15 supplies electrical energy to the circuit board 12, the infrared assembly 13, the atomization assembly 14, the LED assembly 16, and the horn 17, respectively. The LED assembly 16 can vary in different colors, and light emitted by the LED assembly 16 can be transmitted through the housing assembly 11. The horn 17 can send corresponding audios according to different usage scenarios. The infrared assembly 13 is arranged at a front end of the housing assembly 11, and can emit and receive infrared rays. The atomization assembly 14 is fixedly arranged in the housing assembly 11, and water mist obtained after atomization performed by the atomization assembly can be sprayed out of the housing assembly 11. The button assembly 18 is arranged on the circuit board 12, penetrates through the housing assembly 11, and can control on and off as well as function setting of the device.

Referring to FIG. 1 to FIG. 4, in this embodiment, the housing assembly 11 is in a streamline rod shape, and includes a first housing 111 and a second housing 112. The first housing 111 and the second housing 112 are connected through a fastener structure or screw structure to form a hollow cavity. The circuit board 12, the infrared assembly, the atomization assembly 14, the battery 15, the LED assembly 16, and the horn 17 are fixedly arranged in the cavity, respectively. In this embodiment, the first housing 111 is provided with a through hole 1111 and a plurality of horn holes 1112 in a penetrating manner. The position of the through hole 1111 corresponds to the position of the atomization assembly 14. It is convenient to add liquid to the atomization assembly 14 through the through hole 1111. The plurality of horn holes 1112 are uniformly arranged, and the positions of the horn holes correspond to the position of the horn 17, so that it is convenient to diffuse the audios sent by the horn 17. In this embodiment, the housing assembly 11 is detachably connected with a decorating part 19. Users can replace different decorating parts 19 according to their preferences. The infrared rays emitted and received by the infrared assembly 13 can penetrate through the decorating part 19, and the water mist produced by the atomization assembly 14 can be sprayed out from the decorating part 19.

Figure 3:
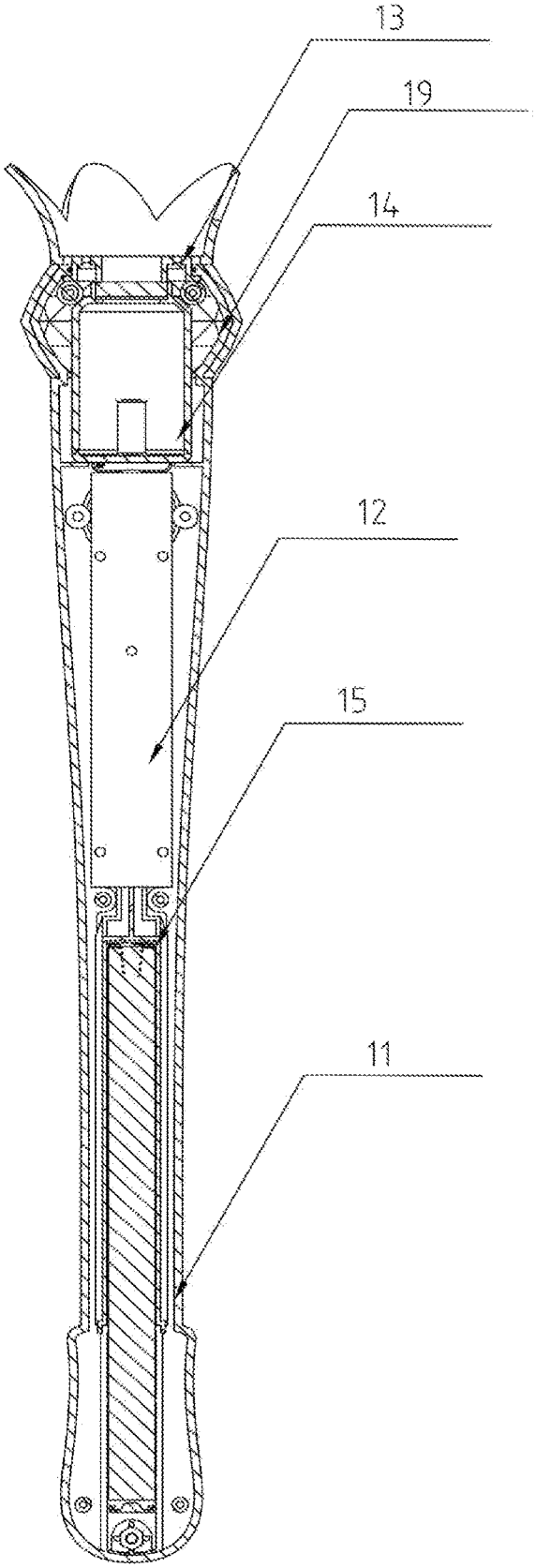
FIG. 3 is a schematic diagram of a sectional structure of the interactive gaming device shown in FIG. 1 according to the present disclosure.
Figure 4:
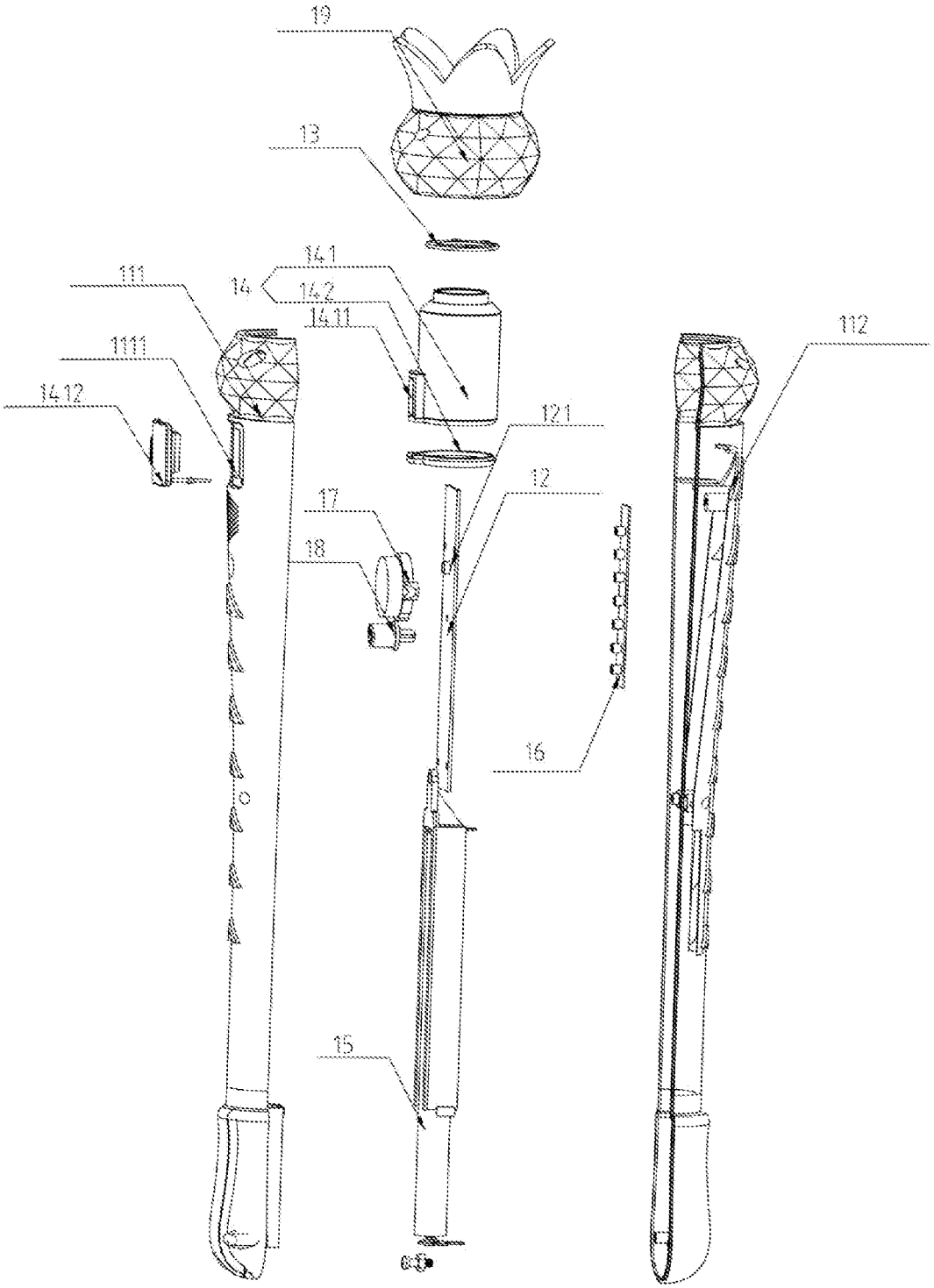
FIG. 4 is a schematic diagram of an exploded structure of the interactive gaming device shown in FIG. 1 according to the present disclosure.

Referring to FIG. 3 and FIG. 4, in this embodiment, the circuit board 12 is electrically connected to the infrared assembly 13, the atomization assembly 14, the battery 15, the LED assembly 16, and the horn 17, respectively. The control technology used is the prior art, so specific control processes and product model numbers used are not described here, as long as they meet the requirements of the present disclosure. The circuit board 12 is provided with a gyroscope 121. The gyroscope 121 detects the movement trajectory of the housing assembly 11 in real time. In some embodiments, the circuit board 12 is further provided with a wireless communication module, the interactive gaming device is wirelessly connected to an electronic terminal through the wireless communication module, so that the device is wirelessly controlled through an application program or a mini program on the electronic terminal. The wireless connection module is also the prior art, which can be one or more of a Bluetooth® wireless communication module, a WI-FI® wireless communication module, a 4G wireless communication module and a 5G wireless communication module.

Referring to FIG. 3 and FIG. 4, in this embodiment, the atomization assembly 14 includes a liquid storage tank 141 and an atomization plate 142. The liquid storage tank 141 is fixedly arranged in the housing assembly 11. The atomization plate 142 is arranged at a bottom of the liquid storage tank 141 and atomizes the liquid flowing out of the bottom of the liquid storage tank 141. In this embodiment, the liquid storage tank 141 is provided with a liquid injection port 1411 in a penetrating manner. The position of the liquid injection port 1411 corresponds to the position of the through hole 1111. Liquid is added to the liquid storage tank 141 through the through hole 1111 and the liquid injection port 1411 in sequence. A blocking cover 1412 is arranged above the liquid injection port 1411. The blocking cover 1412 is movably arranged on a side of the through hole 1111 to prevent the liquid in the liquid storage tank 141 from leaking out of the liquid injection port 1411. In order to improve the sealing performance of the blocking cover 1412, specifically, the blocking cover 1412 is made of silica gel. When the blocking cover 1412 is arranged at the liquid injection port 1411, an upper surface of the blocking cover 1412 is flush with a surface of the housing assembly 11.

Referring to FIG. 3 and FIG. 4, in this embodiment, the battery 15 uses a dry battery. In other embodiments, the battery 15 can also use a rechargeable battery. Specifically, the battery uses a polymer lithium-ion battery. In order to charge the battery 15, the circuit board 12 is further provided with a charging interface. The charging interface penetrates through the housing assembly 11. The charging interface can use a Type-C interface, a micro USB interface, or a Lightning® interface. Preferably, the charging interface uses the Type-C interface. In this embodiment, the LED assembly 16 includes a lamp panel and a plurality of LEDs. The lamp panel is electrically connected to the circuit board 12. The plurality of LEDs are arranged on the lamp panel. The corresponding LEDs are controlled to be lightened in different colors at different twinkling durations through the circuit board 12.

It should be noted that according to the interactive gaming device of the present disclosure, the movement trajectory of the housing assembly 11 is detected in real time through the gyroscope 121. Meanwhile, due to the infrared emission and receiving functions of the infrared assembly 13 and interactive play between different users, when users interacting with one another wave their own housing assemblies 11 simultaneously to trigger a certain preset scenario without contact, the circuit boards 12 respectively control the atomization assemblies 14 to perform spraying operations, control the LED assemblies 16 to be lightened in different colors at different twinkling durations, and/or control the horns 17 to play corresponding audios.

The technical features of the embodiments described above can be arbitrarily combined. In order to make the description concise, all possible combinations of various technical features in the above embodiments are not completely described. However, the combinations of these technical features should be considered as the scope described in this specification as long as there is no contradiction in them.

The above-mentioned embodiments only express several implementation modes of the present disclosure, and their descriptions are more specific and detailed, but they cannot be understood as limiting the patent scope of the present disclosure. It should be noted that those of ordinary skill in the art can further make various transformations and improvements without departing from the concept of the present disclosure, and these transformations and improvements all fall within the protection scope of the present disclosure. Therefore, the protection scope of the patent of the present disclosure shall be subject to the appended claims.

What is claimed is:

1. An interactive gaming device, comprising a housing assembly;

a circuit board, fixedly arranged in the housing assembly;

a gyroscope, fixedly arranged on the circuit board and configured to detect a movement trajectory of the housing assembly in real time;

an infrared assembly, arranged at a front end of the housing assembly and electrically connected to the circuit board, wherein the infrared assembly emits and receives infrared rays;

an atomization assembly, arranged at the front end of the housing assembly and electrically connected to the circuit board, wherein water mist produced by the atomization assembly is sprayed out of the housing assembly;

a button assembly, arranged on the circuit board, penetrating through the housing assembly, and configured to control on and off as well as function setting of the device;

a light-emitting diode (LED) assembly, fixedly arranged in the housing assembly and electrically connected to the circuit board, wherein the LED assembly varies in different colors, and light emitted by the LED assembly is transmitted through the housing assembly; and a battery, fixedly arranged in the housing assembly, electrically connected to the circuit board, and configured to supply electric energy to the circuit board, the gyroscope, the atomization assembly, and the LED assembly respectively, the atomization assembly comprises a liquid storage tank and an atomization plate; the liquid storage tank is fixedly arranged in the housing assembly, and accommodates liquid; and the atomization plate is arranged at a bottom of the liquid storage tank and atomizes the liquid flowing out of the bottom of the liquid storage tank.

2. The interactive gaming device according to claim 1, further comprising a horn, wherein the horn is arranged in the housing assembly and electrically connected to the circuit board; and the horn sends corresponding audios according to different usage scenarios.

3. The interactive gaming device according to claim 2, wherein the housing assembly is in a streamline rod shape.

4. The interactive gaming device according to claim 3, wherein the housing assembly further comprises a first housing and a second housing; the first housing and the second housing are connected through a fastener structure or a screw structure; and the two housings respectively wrap the circuit, the battery, and the LED assembly.

5. The interactive gaming device according to claim 4, wherein the first housing is provided with a through hole and a plurality of horn holes in a penetrating manner; the position of the through hole corresponds to the position of the atomization assembly; the plurality of horn holes are uniformly arranged, and the positions of the horn holes correspond to the position of the horn; and sound produced by the horn is diffused through the plurality of horn holes.

6. The interactive gaming device according to claim 5, wherein a liquid injection port is arranged on the liquid storage tank in a penetrating manner; the position of the liquid injection port corresponds to the position of the through hole; and liquid is added into the liquid storage tank through the liquid injection port.

7. The interactive gaming device according to claim 6, wherein a blocking cover is arranged at the liquid injection port; the blocking cover is movably arranged on a side of the through hole and prevents the liquid in the liquid storage tank from leaking through the liquid injection port.

8. The interactive gaming device according to claim 1, wherein a wireless communication module is further arranged on the circuit board; and the interactive gaming device is wirelessly connected to an electronic terminal through the wireless communication module, so that the device is wirelessly controlled through an application program or a mini program on the electronic terminal.

9. The interactive gaming device according to claim 8, wherein the wireless connection module uses one or more of a Bluetooth® wireless communication module, a Wi-Fi® wireless communication module, a 4G wireless communication module and a 5G wireless communication module.

10. The interactive gaming device according to claim 1, wherein the battery is a dry battery or a rechargeable battery.

11. The interactive gaming device according to claim 10, wherein when the battery is the rechargeable battery, the circuit board is further provided with a charging interface; and the charging interface penetrates through the housing assembly to charge the battery.

12. The interactive gaming device according to claim 11, wherein the battery is a polymer lithium-ion battery.

13. The interactive gaming device according to claim 11, wherein the charging interface adopts a Type-C interface, a micro USB interface, or a Lightning® interface.

14. The interactive gaming device according to claim 1, wherein the LED assembly comprises a lamp panel and a plurality of LEDs; the lamp panel is electrically connected to the circuit board; the plurality of LEDs are arranged on the lamp panel; and the corresponding LEDs are controlled to be lightened in different colors at different twinkling durations through the circuit board.

15. The interactive gaming device according to claim 1, wherein the housing assembly is detachably connected with a decorating part.

* * * * *